US012030736B2

(12) United States Patent
Sforzi

(10) Patent No.: US 12,030,736 B2
(45) Date of Patent: Jul. 9, 2024

(54) REWINDING MACHINE AND METHOD FOR CONTROLLING THE SPEED OF THE MOTORS IN A REWINDING MACHINE

(71) Applicant: A.CELLI PAPER S.P.A., Capannori (IT)

(72) Inventor: Franco Sforzi, Capannori (IT)

(73) Assignee: A. CELLI PAPER S.P.A., Capannori (IT)

( * ) Notice: Subject to any disclaimer, the term of this patent is extended or adjusted under 35 U.S.C. 154(b) by 629 days.

(21) Appl. No.: 17/283,478

(22) PCT Filed: Oct. 3, 2019

(86) PCT No.: PCT/IB2019/058419
§ 371 (c)(1),
(2) Date: Apr. 7, 2021

(87) PCT Pub. No.: WO2020/075018
PCT Pub. Date: Apr. 16, 2020

(65) Prior Publication Data

US 2022/0009739 A1 Jan. 13, 2022

(30) Foreign Application Priority Data

Oct. 8, 2018 (IT) ..... 102018000009236

(51) Int. Cl.
*B65H 23/18* (2006.01)

(52) U.S. Cl.
CPC ..... *B65H 23/1806* (2013.01); *B65H 2301/41485* (2013.01); *B65H 2513/11* (2013.01); *B65H 2515/31* (2013.01); *B65H 2701/1924* (2013.01)

(58) Field of Classification Search
CPC .... B65H 23/18; B65H 23/1806; B65H 35/02; B65H 2301/41485; B65H 2513/11
See application file for complete search history.

(56) References Cited

U.S. PATENT DOCUMENTS 4,342,432 A * 8/1982 Lund ..... B65H 23/1806 242/530.4
5,657,941 A 8/1997 Simons et al.
(Continued)

FOREIGN PATENT DOCUMENTS

EP 0057523 A1 8/1982
EP 0367901 A2 5/1990
(Continued)

OTHER PUBLICATIONS

ABB press release Oct. 2009 "Korsnäs AB Gävle, Sweden has successfully installed Pressductor Pillowblock load cells providing an accurate web tension measurement".
(Continued)

*Primary Examiner* — Sang K Kim
(74) *Attorney, Agent, or Firm* — McGlew and Tuttle, P.C.

(57) ABSTRACT

The rewinding machine (1) comprises: a winding station (3) with winding members (5, 7) operated by winding motors (8.1, 8.2); an unwinder (31.1, 31.2) with an unwinding member (35.1, 35.2) operated by at least one unwinding motor (38.1, 38.2); guide roller (43.1, 43.2) along a feed path (P) of the web material (N, N2). There is associated with the guide roller (43.1, 43.2) at least one load sensor (42.1, 42.2), adapted to detect a parameter proportional to the tension of the web material (N; N2) guided around the guide roller (43.1, 43.2). There is also provided a control unit (71) adapted to modulate a difference in speed between the winding members (5, 7) and the unwinding member (35.1, 35.2) as a function of a signal coming from the load sensor (42.1, 42.2).

20 Claims, 5 Drawing Sheets

(56) References Cited

U.S. PATENT DOCUMENTS

| | | | | |
|---|---|---|---|---|
| 6,629,663 | B1 * | 10/2003 | Bettendorf | B65H 18/00 242/534 |
| 9,221,641 | B2 * | 12/2015 | Dollevoet | B65H 43/00 |
| 9,260,266 | B2 * | 2/2016 | Föhr | B65H 35/02 |
| 2004/0108403 | A1 | 6/2004 | Jeyama et al. | |
| 2005/0253013 | A1 | 11/2005 | Benvenuti et al. | |
| 2006/0038051 | A1 | 2/2006 | Betti et al. | |
| 2006/0076449 | A1 * | 4/2006 | Stitz | B65H 19/28 242/525 |
| 2008/0148914 | A1 | 6/2008 | Micheli | |
| 2014/0013847 | A1 * | 1/2014 | Decoux | G04D 7/001 73/579 |
| 2018/0127227 | A1 * | 5/2018 | Nishimura | B65H 35/02 |

FOREIGN PATENT DOCUMENTS

| | | | |
|---|---|---|---|
| EP | 1245354 | A1 | 10/2002 |
| EP | 1245519 | A1 | 10/2002 |
| IT | 102001900963929 | | 4/2003 |
| JP | H09172795 | A | 6/1997 |
| WO | 9628284 | A1 | 9/1996 |
| WO | 9628285 | A1 | 9/1996 |
| WO | 2012001211 | A1 | 1/2012 |

OTHER PUBLICATIONS

IEEE Transactions on Industrial Electronics, vol. 57, No. 8, Aug. 2010, "Realization of Rewinder With a Reduced Number of Sensors" Borislav I. Jeftenić and Milan Z. Bebić, Member, IEEE, pp. 2797-2806.

"Pulp and Paper Manufacture vol. 7 Paper Machine Operations", 1991, p. 676 and pp. 390-393.

* cited by examiner

Fig.5
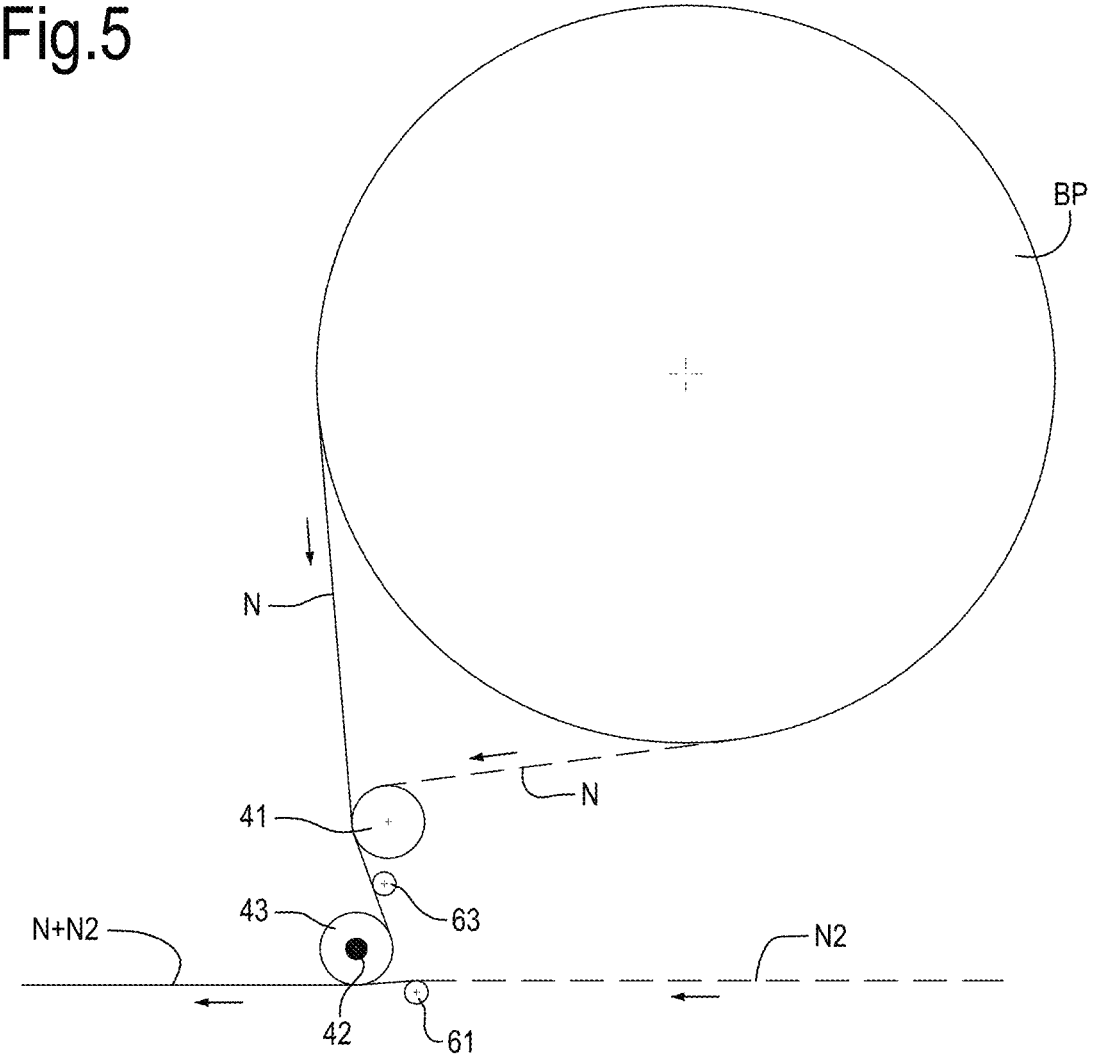
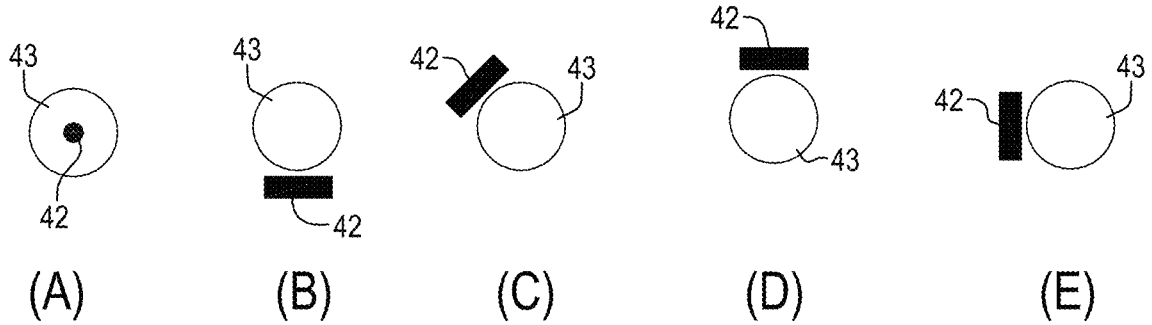
Fig.6

REWINDING MACHINE AND METHOD FOR CONTROLLING THE SPEED OF THE MOTORS IN A REWINDING MACHINE

TECHNICAL FIELD

Disclosed herein are rewinding machines and methods for winding a web material, in particular a single-ply or multi-ply cellulose material, such as tissue paper. Embodiments described concern in particular methods and machines for forming reels of tissue paper.

BACKGROUND ART

One of the characteristics of tissue paper, with which paper napkins, toilet paper, kitchen towels, paper handkerchiefs and the like are produced, is that of being creped. Creping is a crinkling of the product that is created in the continuous paper machine for the production of tissue paper, by means of a creping doctor blade that co-acts with a Yankee cylinder or roller and due to the difference in speed between the Yankee roller and the winding roller of the winder that receives the continuous cellulose ply coming from the production machine, winds it into primary reels, or so-called parent or jumbo reels.

A high degree of creping, even in the order of 18%-25%, is required for some products that reach the final consumer.

The greater the degree of creping is, the lower the production of the tissue paper machine will be, as the grammage of the cellulose ply on the Yankee roller must be lower. For example, if the grammage of the paper on the reel wound downstream of the Yankee roller is 15 g/m$^2$, a creping ratio of 20% requires a grammage on the Yankee roller of 12 g/m$^2$. The speed of the production line of the cellulose ply is given by the peripheral speed of the Yankee roller. Therefore, the greater the creping required on the cellulose ply wound in the primary reel is, the lower the grammage of the cellulose ply on the Yankee roller, and ultimately the lower the amount of paper produced by the continuous machine, will be.

Subsequent technological processes of the cellulose ply can cause a reduction in the creping present on the ply delivered from the continuous paper machine.

For the paper manufacturer, it is important that any technological process performed downstream of the machine for producing the cellulose ply reduces creping of the product to the least possible extent. If the final client requires a product with a creping of 18% and the technological processes downstream of the paper machine reduce creping by 5%, the continuous paper machine must produce a product with 5% more creping with respect to the creping required in the final product, i.e., in the example considered a creping of 23%. This in fact leads to a 5% production loss for the paper mill. Instead, if the technological processes downstream of the paper machine are more efficient and reduce creping by only 2%, the continuous paper machine will only require to produce a product with 2% more creping than 18%, i.e., 20%. This greater efficiency of the technological processes downstream of the paper machine results into higher production for the paper mill with an increase in profits.

One of the technological processes required to process the product downstream of the continuous paper machine is rewinding in a rewinder. This machine can combine several plies of product and/or cut the product into different formats and/or produce reels of different diameter. The rewinder comprises one or more unwinders that unwind the web material from one or more parent reels, a cutting assembly for cutting the web material into different formats and a winding assembly, usually comprising at least one pair of motorized rollers, in which strips of web material coming from the unwinder are wound in respective reels, hereinafter called secondary reels.

To unwind and rewind said web material in the rewinder, the motors of the unwinder must impart to the parent reel a peripheral speed lower than the peripheral speed imparted by the motors of the winding assembly to the secondary reels in the winding assembly. The technical term for this difference in speed is "slip". The greater the speed of the rewinder is, the greater said difference must be. This is because the greater the feed speed of the web material is, the greater the tension imparted to the material must be, to prevent it from being subjected to vibration, oscillation or drifting, for example due to aerodynamic effects. The speed of the rewinder is in general the feed speed of the web material to the secondary reels being wound, i.e., the peripheral speed of the winding rollers of the winding assembly. The tension applied to the cellulose plies causes a reduction in the creping thereof, as the tensile force tends to flatten the cellulose fibers.

The greater the slip (i.e., the difference in speed of the drive motors) is, the greater the force with which the paper is pulled will be, and hence the greater the loss of creping and consequently the loss of thickness of the paper will be. This loss can also be defined as loss of bulk of the paper or of the wound reel defined by the standard EN ISO 12625-3.

The rewinding machines in question are "start-stop" machines, i.e., machines in which series of rewound reels are produced in sequence, in winding cycles that comprise the steps of: inserting winding cores into the winding assembly or station with the machine stopped; starting rotation of the parent reel in the unwinder and rotation of the winding cores in the winding assembly, to start forming the secondary reels in the winding assembly, and accelerating the speed up to a maximum operating speed; performing part of the winding at operating speed; gradually slowing the feed speed of the web material until the rewinding machine stops completely, to remove the secondary reels from the winding assembly, after cutting the strips of web material wound on each of these reels and to allow insertion of a new series of winding cores for the subsequent cycle.

Therefore, the feed speed of the web material undergoes cyclical variations of acceleration from zero to an operating speed, running at the operating speed (maximum speed) and subsequent slowing until it stops.

In prior art rewinding machines, the slip (i.e., the percentage difference in speed between winding rollers and unwinding member of the unwinder) is set as a function of the operating speed of the rewinder for the specific product. In other terms, the web material is stretched to the tension required for the operating speed that is reached in the intermediate step of the winding cycle. This tension can vary from one material to another, for example as a function of characteristics of thickness, grammage, number of plies, and the like. As optimal slip is a function of the speed, this means that during the acceleration and deceleration transients the slip set is different from the required slip.

In fact, prior art rewinding machines do not have any adaptive control of slips during the winding cycle. As stated previously, the greater the slip is, the greater the loss of volume (bulk) of the cellulose web material will be. This means that prior art rewinders cause an excessive loss of bulk between the start of the reel and reaching maximum operating speed, and subsequently between the start of the deceleration ramp from operating speed and stopping of the rewinding machine, once the reel is completed. As the rewinders in question are start-stop machines, the acceleration and deceleration steps occupy a substantial part of the whole winding cycle, which means that the reduction in creping and hence of bulk of the web material wound becomes significant.

Therefore, there is the need for improved control of rewinders, in particular with regard to slip, i.e., the difference in speed between winding rollers and unwinding members of the unwinder, in order to solve or reduce the problems of the prior art illustrated above.

SUMMARY OF THE INVENTION

The invention disclosed herein provides for automatically adjusting the slip of the motors respecting a tension set in the control panel. The system provides for the insertion of at least one load cell for each unwinder to detect the force with which the web material is pulled at each moment of the winding cycle.

According to a first aspect, there is provided a rewinding machine for unwinding primary reels of a web material and rewinding said web material in secondary reels, comprising a winding station with winding members, operated by at least one winding motor, and at least one unwinder, with at least one unwinding member operated by an unwinding motor. In some embodiments, the rewinding machine can comprise a plurality of unwinders in combination, for example two or three unwinders in sequence. The rewinding machine further comprises at least one guide roller along a feed path of the web material. If the rewinding machine comprises several unwinders, advantageously a guide roller will be provided for each unwinder. Advantageously, at least one load sensor can be associated with each guide roller, which is adapted to detect a parameter proportional to the tension of the web material guided around the guide roller, i.e., the tensile force to which the web material coming from the unwinder is subject. Moreover, there is provided a control unit adapted to modulate a difference in speed between the winding members of the winding station and the unwinding member of the unwinder or of each unwinder, as a function of a signal from the load sensor or from each load sensor.

As will be described in detail hereunder with reference to exemplary embodiments, the rewinding machine can comprise two or more unwinders, to unwind two or more web materials. In this case, each unwinder will have at least one unwinding member with related motor interfaced with the control unit. Moreover, advantageously a guide roller will be provided for each unwinder, with which a load sensor is associated. The guide rollers associated with the load sensors are positioned so as to be able to detect the tension to which each web material is subjected and so that the tensions to which different web materials, coming from different unwinders, are subjected do not influence one another.

In some embodiments, the control unit is configured to vary the speed of the unwinding member, and hence of the primary reel in the unwinder, as a function of the signal of the load sensor, so as to maintain the tension in the web material around a desired value. Preferably, the control unit is configured to vary the speed of the unwinding member as a function of a preset speed profile. In this way it is possible, for example, to control the tension of the web material as a function of the winding speed of the web material, in particular of the speed of the winding members of the winding station. By way of example, the tension can be higher for higher feed speeds, and vice versa.

The rewinding machine can be a start-stop machine and the speed profile can thus comprise an acceleration ramp from zero speed, a period of substantially constant speed, and a deceleration ramp to zero speed.

In some embodiments, the control unit is configured to vary the speed of the unwinding member, and hence of the primary reel in the unwinder, as a function of the signal of the load sensor, so as to maintain the tension in the web material around a desired value that can be a function of one or more parameters or characteristics of the web material or of the operating conditions of the rewinding machine. The desired tension of the web material can be set not only as a function of the winding speed, but also as a function of the grammage of the web material, the percentage of creping, the type of production process used to produce the web material, the diameter of the primary reel and/or of the secondary reel, and the format (width) of the web material.

In advantageous embodiments, the rewinder can comprise a cutting device adapted to divide the web material into a plurality of longitudinal strips. In some embodiments, the winding station is adapted to wind the single strips in respective secondary reels placed side by side to one another. In other embodiments, the rewinder can be without a cutting device, or can operate with the cutting device deactivated. In this case, the secondary reels that are produced have the same axial dimension as the primary reel, but smaller diameters.

In particularly advantageous embodiments, the rewinding machine is configured so that the motor/motors in the winding station is/are controlled as "master", while the unwinding motor/motors in the unwinder/unwinders is/are controlled as "slave". In this way, by means of the control unit of the rewinding machine it is possible to impart a winding speed profile to the winding station, for instance. The speed of the unwinder/unwinders can vary as a function of the tension of the web material, so as to maintain said tension at the desired value, or within a desired interval, modulating the unwinding speed, for each value of the winding speed.

According to a further aspect, a method for rewinding a web material is provided, comprising the steps of:

- unwinding a primary reel of web material comprising at least one ply of tissue paper by means of at least one unwinding member controlled by an unwinding motor;
- winding the web material in a winding station by means of at least one winding motor and forming at least one secondary reel in the winding station;
- detecting a parameter function of the tension of the web material along the path between the unwinding member and the winding station;
- controlling the difference between the speed of the winding motor and the speed of the unwinding motor as a function of said parameter.

In particularly advantageous embodiments, the method comprises the step of modulating the speed of at least one of said unwinding motor and winding motor to maintain the tension of the web material around a given value. The given value can be fixed, or in turn a function of one or more quantities or parameters of the web material and/or of the rewinding machine in which winding takes place.

In advantageous embodiments, the following steps are provided: winding the web material at a winding speed according to a profile by means of a control unit; and modulating the unwinding speed as a function of said parameter that is a function of the tension, to maintain the tension of the web material around a given value.

Further advantageous features and embodiments of the method and of the rewinding machine are described below with reference to the accompanying drawings.

BRIEF DESCRIPTION OF THE DRAWINGS

The invention will be better understood by following the description and the accompanying drawings, which illustrate an exemplifying and non-limiting embodiment of the invention. More particularly, in the drawings:

FIG. 5 shows a diagram of an unwinder in a variant of embodiment;

FIGS. 6(A)-6(E) show diagrams of alternative positionings of the load cells.

DETAILED DESCRIPTION OF EMBODIMENTS

The following detailed description of embodiments given by way of example refers to the accompanying drawings. The same reference numbers in different drawings identify identical or similar elements. Moreover, the drawings are not necessarily to scale. The following detailed description does not limit the invention. Rather, the scope of the invention is defined by the accompanying claims.

Reference in the description to "an embodiment" or "the embodiment" or "some embodiments" means that a particular feature, structure or element described in relation to an embodiment is included in at least one embodiment of the object described. Therefore, the phrase "in an embodiment" or "in the embodiment" or "in some embodiments" used in the description does not necessarily refer to the same embodiment or embodiments. Furthermore, the particular features, structures or elements may be combined in any appropriate manner in one or more embodiments.

Figure 1:
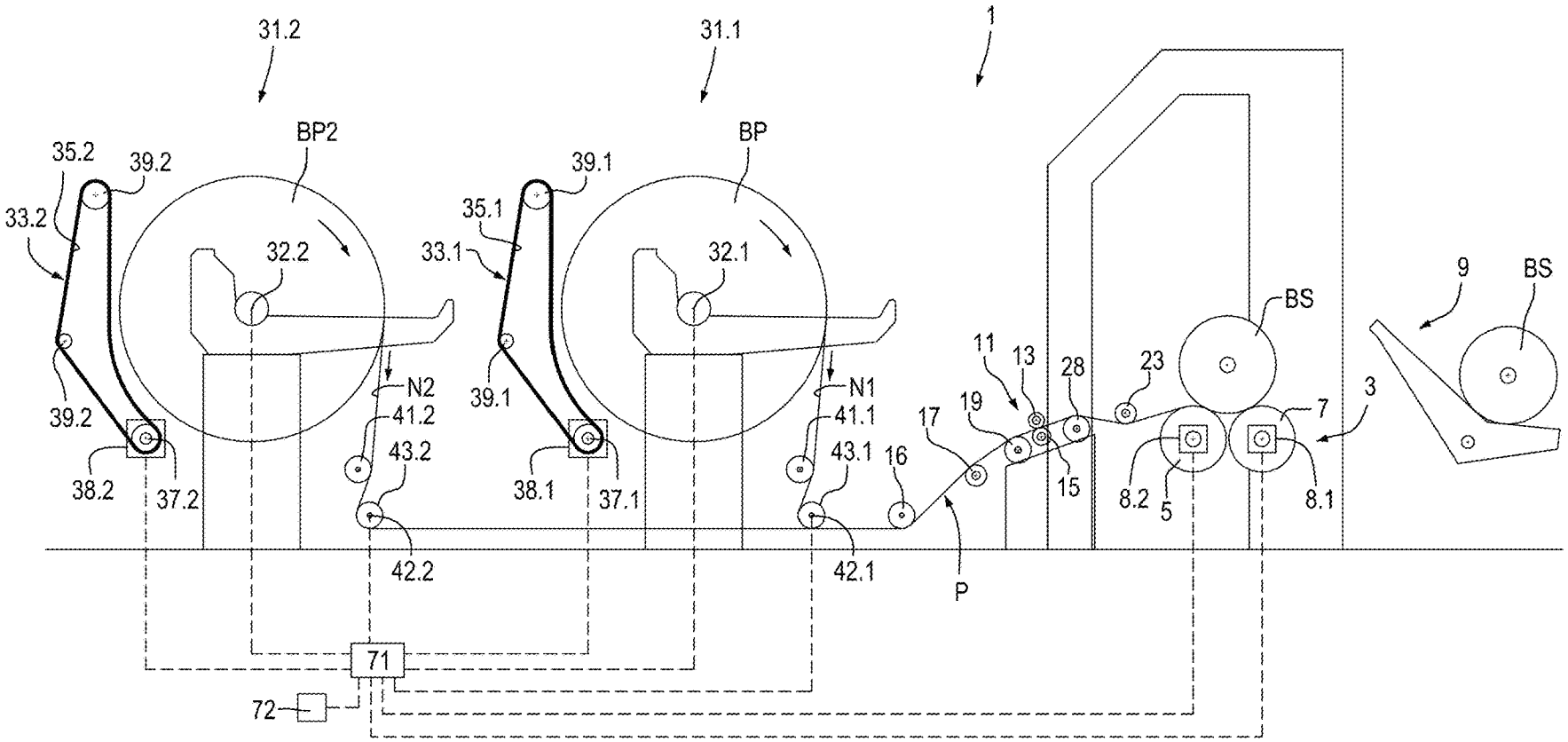
FIG. 1 shows a diagram of an example of rewinding machine according to the invention.

With initial reference to the embodiment of FIG. 1, a rewinder 1 comprises a winding station or assembly 3, in which a web material N, unwound from a primary reel BP or parent reel, is wound on one or more secondary reels BS. The feed path of the web material N toward the winding station 3 is indicated with P. The web material N is typically and in particular a continuous web or sheet of tissue paper, consisting of one or more plies placed one on top of the other. The web material N can be fed from a single primary reel BP, which can comprise a single ply or several plies wound together. In other embodiments, two or more plies can be fed from two or more primary reels unwound in the same number of stations of an unwinder or in several unwinders in sequence. The diagram of FIG. 1 illustrates two unwinders, as described in greater detail hereunder. The direction of feed of the web material N is indicated with F. The secondary reels BS form around tubular winding cores A (FIG. 2) arranged in the winding station 3.

The overall structure of the rewinder 1 can be of a type know per se; therefore, only the main parts, useful for understanding the present invention, will be described.

More in particular, in the embodiment illustrated in FIG. 1 the rewinder 1 is a rewinder-slitter, or slitter-rewinder, which receives a web material N and divides it into a plurality of longitudinal strips S, each of which is wound on a secondary reel BS. Several secondary reels BS placed side by side and substantially coaxial to one another are located in the winding station 3 to each receive and wind a respective strip of web material. The reels BS can wind around winding cores mounted on an expansible winding shaft, so as to maintain the correct transverse position with respect to the web material fed to the winding station 3.

A cutting assembly or device, described below, is provided to divide the web material N into longitudinal strips. In some operating modes, the cutting device can be inactive. In this case, the secondary reels BS produced will have an axial dimension the same as the axial dimension of the primary reels BP, but with a smaller diameter.

In other embodiments, the rewinder can be without a cutting assembly and can be used to produce secondary reels BS of an axial length the same as the axial length of the primary reels BP, but with a smaller diameter.

In some embodiments, the winding station 3 comprises a winding cradle. In the embodiment illustrated in FIG. 1 the winding cradle comprises peripheral winding members. Peripheral winding members are meant as members that transmit a winding torque to the reel being formed as a result of the contact between the winding member and the substantially cylindrical lateral surface of the reel. It would also be possible for the winding station to comprise central winding members, or a combination of central winding members and peripheral winding members. The central winding members can comprise motorized tailstocks that axially engage the secondary reels BS and maintain them in rotation.

The peripheral winding members can comprise winding rollers, for example two winding rollers 5 and 7, which together form the winding cradle. Each winding roller rotates around its axis, for example controlled by an electric motor. The embodiment illustrated shows two separate motors 8.1, 8.2, one for each winding roller 5, 7. In other embodiments a single motor can be provided, with a transmission system to operate both of the winding rollers 5, 7.

The rotation axes of the winding rollers 5, 7 are parallel to one another and the secondary reels BS rest on the winding rollers 5, 7 by gravity. In the embodiment illustrated the rotation axes of the winding rollers 5, 7 are on a horizontal plane, but this configuration should be considered as a non-limiting example. In some embodiments the rotation axes of the winding rollers 5, 7 can be on an inclined plane. Moreover, it would also be possible to provide further winding members, for example a third winding roller positioned above the reels BS and having a movable axis to follow the increase of the secondary reels BS during the winding cycle.

A system for unloading and moving the completed secondary reels BS away from winding station 3 is indicated as a whole with 9.

The rewinder 1 further comprises a cutting device or assembly 11, which can comprise a series of disc-shaped knives or disc-shaped blades 13 co-acting with a series of corresponding counter-blades 15 or with an anvil roller. The cutting device 11 can be configured in a manner known per se. Examples of cutting devices are disclosed in EP1245354 and EP1245519, WO96/28285, WO96/28284, US2008/0148914, for instance.

Figure 2:
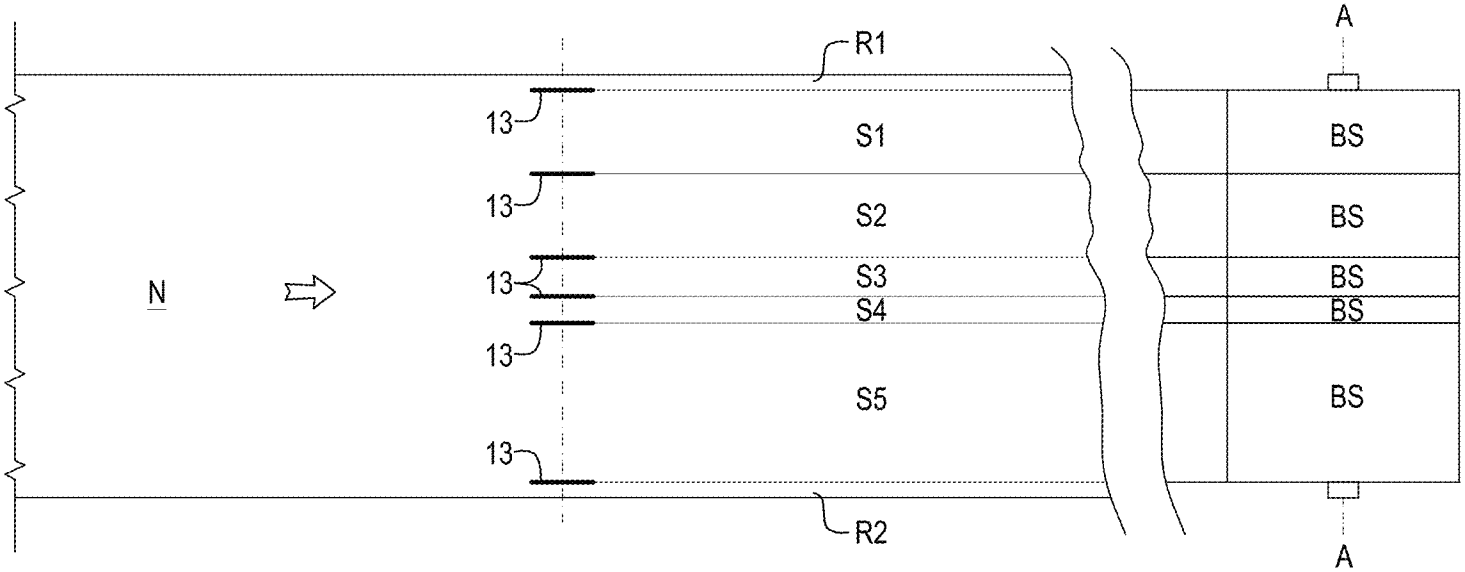
FIG. 2 shows a schematic view of a web material that is divided into strips to form secondary reels wound in the rewinding machine.

Each blade 13 and each counter-blade 15 can be adjustable in a transverse direction, i.e., orthogonally to the feed path P, of the web material N and orthogonally to the plane of FIG. 1, to cut longitudinal strips of web material N having suitable widths. Schematically and by way of example, the diagram of FIG. 2 shows six cutting blades 13 that divide the web material N into five longitudinal strips S1, S2, S3, S4 S5 and two edge trimmings R1, R2. The number of longitudinal strips is by way of example. In general, the web material N can be divided into a plurality of "n" strips S1-Sn and two edge trimmings. FIG. 2 also shows a winding shaft around which the secondary reels BS are wound.

Along the feed path P of the web material N, upstream of the cutting device 11, guide rollers can be arranged, two of which are indicated by way of example with 16, 17 and 19. Downstream of the cutting device there can be arranged further guide rollers, one of which is indicated by way of example with 28. The number and the position of the guide rollers are provided purely by way of example. In some embodiments, one of the rollers upstream of the cutting device 11, for example the roller 17, can be a spreader roller, or bowed roller or curved roller, which stretches the web material N transversely to remove wrinkles or creases. A spreader roller, indicated schematically with 23 can be provided also downstream of the cutting device 11.

One or more of the guide rollers and/or of the spreader rollers can be motorized at a suitable speed, to prevent the torque necessary for their rotation from being imparted by the web material N, as this would cause an increase in the tension of the web material and hence an undesirable reduction in its thickness.

The rewinder 1 comprises at least one unwinder. In the embodiment of FIG. 1, the rewinder 1 comprises a first unwinder 31.1 and a second unwinder 31.2. Unwinding members of the primary reels, indicated with BP and BP2, are provided in the unwinders to unwind the web material indicated with N and N2, respectively. The unwinders 31.1 and 31.2 shown in FIG. 1 are substantially identical. This can be particularly preferred, but is not binding. Moreover, in FIG. 1 the two unwinders 31.1 and 31.2 operate in parallel. In some operating conditions the two unwinders can be operated alternately, in the sense that while one unwinder feeds a web material, operations to replace an empty primary reel can be carried out in the other unwinder. Moreover, it would also be possible to provide a larger number of unwinders, for example three unwinders in sequence.

The unwinding members of each unwinder 31.1 and 31.2 can comprise tailstocks that axially engage the primary reel BP. The tailstocks can be motorized. In FIG. 1, motorized tailstocks for the two unwinders are schematically indicated with 32.1 and 32.2. In other embodiments, as illustrated schematically in FIG. 1, each unwinder comprises one or more peripheral unwinding members. By way of example, the unwinders 31.1 and 31.2 comprise peripheral unwinding members 33.1 and 33.2, respectively, each of which can comprise one or more endless belts 35.1, 35.2 guided around pulleys 37.1, 39.1 and 37.2, 39.2, respectively. In each peripheral unwinding member, one of the pulleys (for example the pulley 37.1, 37.2) is motorized, for example by means of an unwinding motor 38.1, 38.2. Guide rollers 41.1, 43.1 and 41.2, 43.2 can be provided to guide the web material N, N2 from the respective primary reel BP, BP2 toward the feed path. In other embodiments, only central unwinding members, or only peripheral unwinding members, can be provided.

The motors 38.1, 38.2, and, if present, the motors of the tailstocks 32.1, 32.2 can be controlled by a programmable control unit 71, which can be associated with one or more user interfaces 72. In addition to the motors of the unwinder 31, also the motor/motors 8.1 and 8.2 for controlling the winding rollers 5, 7 can be controlled by the control unit 71. In general, the control unit 71 can control the rotation speed of a plurality of motorized members along the feed path of the web material N from the unwinders 31.1, 31.2 to the winding station 3, including the blades 13 and/or the counter-blades 15, the spreader roller 16, the spreader roller 23, and the guide rollers.

The web materials N, N2 are combined upstream of the spreader roller 16 to follow the same feed path P through the cutting device 11 and until reaching to the winding station 3.

While in FIG. 1 the rewinder 1 comprises two unwinders 31.1 and 31.2, in other embodiments the rewinder 1 can comprise a single unwinder, i.e., a multiple unwinder, adapted to simultaneously unwind a plurality of parent reels or primary reels BP, to feed a greater number of plies of cellulose web material to the winding assembly.

Figure 3:
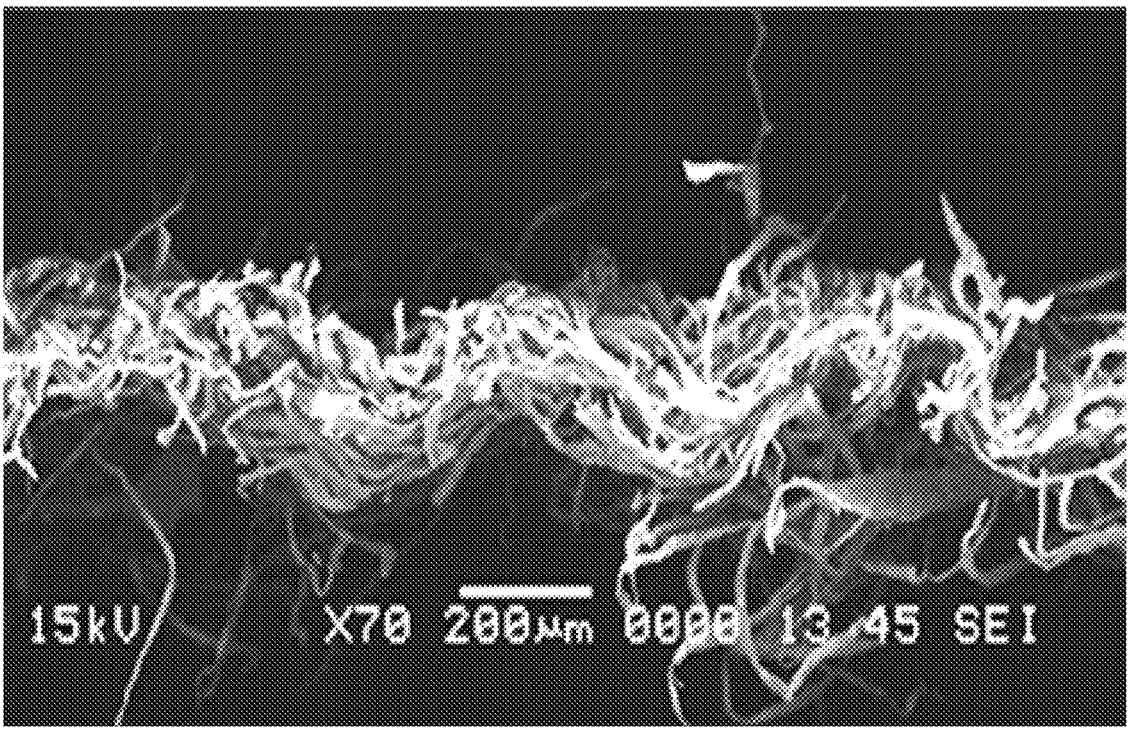
FIG. 3 shows a microphotograph of a section of tissue paper.

FIG. 3 shows a microphotograph of a cellulose web material consisting of tissue paper, i.e., creped paper, for example produced by a continuous paper machine with a wet process. As known to those skilled in the art, the ply of tissue paper is formed in these machines starting from an aqueous suspension of cellulose fibers that is fed on a forming wire. By means of subsequent draining steps, water is gradually removed to obtain a ply of cellulose slurry sufficiently consistent to be guided around a heated Yankee roller, to remove further water from the slurry. The ply is then detached from the Yankee roller by means of a creping doctor blade, which causes the typical creping of the tissue paper, visible in the enlargement of FIG. 3. As discussed in the introduction to the present description, it is advisable to control the winding cycle so that creping of the web material, visible in FIG. 3, is not lost, or is lost to the least possible extent, before winding on the secondary reels BS.

Figure 4:
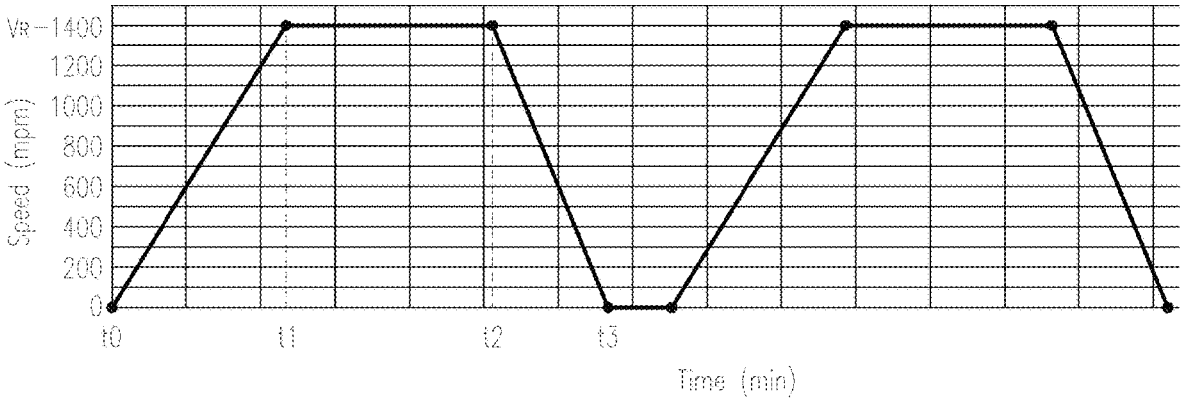
FIG. 4 shows a speed diagram of the winding cycles.

FIG. 4 shows the winding speed as a function of time for two subsequent winding cycles. The diagram of FIG. 4 shows that the rewinding machine 1 is of start-stop type, i.e., performs successive winding cycles spaced by stops for replacement of the secondary reels BS with new winding cores. In the diagram of FIG. 4 the abscissa indicates the time and the ordinate the peripheral speed of the winding rollers 5, 7, which corresponds to the peripheral speed of the secondary reels BS being wound, in meters per minute. Each winding cycle is characterized by an acceleration ramp from zero to a maximum operating speed (VR), in the example indicated of 1400 m/min. The acceleration ramp lasts for an interval of time t1-t0. The operating speed is maintained for an interval of time (t2-t1), followed by a deceleration ramp (interval of time (t3-t2)), until stopping to allow removal of the reels formed and replacement thereof with a series of new winding cores.

One or more load sensors, i.e., members adapted to detect a force, can be associated with one of the guide rollers of each web material N, N2 along its path from the respective unwinder 31.1, 31.2 to the winding station 3. Hereinafter the load sensors will be indicated as "load cells". In FIG. 1 the load cell or cells can be associated with the roller 43.1, 43.2 of each of the two unwinders 31.1 and 31.2. A load cell is schematically indicated with 42.1 and 42.2 for the two guide rollers 43.1, 43.2, respectively.

The guide roller 41.1, 41.2 upstream of the roller 43.1, 43.2, with which the load cell 42.1, 42.2 is associated, serves to maintain a constant winding angle of the web material N, N2 around the subsequent guide roller 43.1, 43.2 regardless of the diameter of the primary reel BP, BP2. This is useful to have a coherent value of the signal detected by the load cell/cells 42.1, 42.2 associated with the respective guide rollers 43.1, 43.2.

In some embodiments, the guide rollers 41.1, 41.2 and 43.1, 43.2 can be made of carbon fiber, to have a low inertia. However, it would also be possible for the guide rollers 41.1, 41.2 and 43.1, 43.2 to be made of other materials, for example steel or aluminum. It is also possible to use different materials for the two guide rollers associated with each unwinder, for example a material with a lower specific weight for the guide roller 43.1, 43.2 and a material with a higher specific weight for the guide roller 41.1, 41.2, respectively.

In some embodiments, to prevent the web material from transmitting the torque to the guide rollers 41.1, 41.2 and 43.1, 43.2, which would influence the tension of the web material N, N2, reducing its thickness, the rollers 41.1, 41.2 and 43.1, 43.2 can advantageously be motorized. In some solutions, where it is necessary to reduce the cost of the rewinding machine, it is possible to use less costly solutions, which use idle guide rollers 41.1, 41.2 and 43.1, 43.2 or one idle roller and one motorized roller associated with each unwinder.

If a single load cell is provided for each guide roller 43.1, 43.2, this can advantageously be arranged at one of the end bearing of the guide roller. If more than one load cell, for example two load cells, are provided, these can be associated with both ends of the guide roller 43.1, 43.2, for example associated with the two end bearings.

The arrangement of the paths of the web materials N, N2 coming from the two unwinders 31.1, 31.2, and in particular the arrangement of the guide rollers 41.1, 41.2 and 43.1, 43.2 is such that the load cells 42.1, 42.2 arranged to detect the tension of the two web materials N, N2 only detect the tension of the respective web material. In particular, the path of the web material N2 is such that the tension to which it is subjected in no way affects the signal generated by the load cell 42.1. For this purpose, in the embodiment illustrated the path of the web material N2 is tangent to the guide roller 43.1, with which the load cell 42.1 is associated.

The load cells 42.1, 42.2 can be interfaced with the programmable electronic control unit 71, to supply a signal proportional to the tension applied to the respective web material N, N2 guided around the guide roller 43.1, 43.2, respectively. The signal supplied by the load cells serves to modulate the speed of the motorized rollers located along the feed path P and of the (peripheral and/or central) unwinding members of the two unwinders 31.1, 31.2, and hence control the slip. Hereunder, it is assumed that the unwinders only have peripheral unwinding members 33.1, 33.2.

More in particular, in some embodiments the control unit 71 can be configured to impart to the winding rollers 5, 7, by means of the respective motors 8.1, 8.2, a peripheral speed according to the curve illustrated in FIG. 4. The speed of the unwinders 31.1, 31.2 is consequently controlled so that the tension of the web material N, N2 is equal to a desired value T0. In some embodiments, a tolerance interval can be defined around the desired value T0, for example an interval defined between a lower threshold Tth1 and an upper threshold Tth2, around a value T0 of optimum tension.

In particular, the signal of the load cells 42.1, 42.2 supplies information that allows the control unit 71 to modulate the speed of the motors 38.1, 38.2 and/or of the motorized tailstocks of the two unwinders that control the rotation of the primary reels BP and BP2 in the unwinders 31.1, 31.2. The peripheral speed of the primary reel or parent reel BP, BP2 in each unwinder 31.1, 31.2 is controlled by the control unit 71 by means of the motors 38.1, 38.2 so as to be lower than the peripheral speed of the winding rollers 5, 7. The difference, defined by the slip of the respective rotation motors 8.1, 8.2 and 38.1, 38.2, is modulated to maintain the desired tension of the web material N, N2 at the value T0 or more in general in the tolerance interval (Th2-Th1) around this value. Moreover, the control unit 71 can be programmed to set the peripheral speed of the various rotating members in contact with the web material N, N2 along the path from the respective unwinder 31.1, 31.2 to the winding station 3 according to a speed profile increasing from a speed $V_{BP}$ (peripheral speed of the primary reel BP, BP2) to a speed $V_{BS}$ (peripheral speed of the secondary reel BS).

In some embodiments, the desired tension value T0 can be fixed. In other embodiments, the desired tension value T0 can advantageously be a function of the type of web material N that is unwound and rewound or of the characteristics of the primary (BP, BP2) and secondary BS reel/reels, for example the diameter. For example, the value T0 can be higher for web materials with a higher tensile strength and/or for web materials that, due to their characteristics, are more subject to fluctuations due to aerodynamic effects.

In some embodiments the value T0 can be independent from the feed speed of the web material. However, it would also be possible for the control unit 71 to be programmable so that the value T0 is a function of the feed speed of the web material N, N2, for example so that T0 increases as the feed speed increases, to take account that at higher feed speeds drifting or other effects of an aerodynamic nature on the web material N, N2 can be higher and therefore a higher tension can be required in order to control it correctly. At lower speeds the tension T0 required to guide the web material N, N2 could be lower. Consequently, the value T0 could vary, not only as a function of the characteristics of the web material, but also as a function of the feed speed thereof, from a minimum at the time t0 to a maximum in the interval t2-t1.

With an arrangement of the type described and by means of the control unit 71 it is thus possible to ensure that the difference between the rotation speed of the motors 8.1, 8.2 that control the winding rollers 5, 7 of the winding station 3 and the rotation speed of the motors 38.1, 38.2 that control the unwinders 31.1, 31.2 is such as to optimize the tension of the web material N, N2 during the whole of the winding cycle t3-t0, thereby minimizing the negative effect of the tension of the web material N, N2 on the thickness of the tissue paper and in particular on the degree of creping thereof.

If the unwinder has central unwinding members, rather than peripheral unwinding members, or a combination of central and peripheral unwinding members, specific motors can be provided for the central unwinding members. In this case, the rotation speed of these motors must take account of the instantaneous diameter of the primary reel BP, BP2, so that it has the desired peripheral speed as the diameter varies.

While the embodiment of FIG. 1 shows two unwinders 31.1, 31.2, it must be understood that in some embodiments the rewinding machine 1 can comprise a single unwinder 31, or more than two unwinders 31 in sequence, for a web material N, or more than two web materials N, N2 in parallel, each of the which can be formed by one or more plies of creped cellulose material.

FIG. 5 schematically shows, in an enlarged scale, the path of a first web material N, delivered by a first primary reel BP in the unwinder 31.1, provided with guide rollers, indicated here with 41 and 43. The other components of the rewinding machine are not shown for the sake of simplicity. A second web material N2 is fed from a second unwinder (not shown in FIG. 5). In some embodiments a spreader bar 61 can be provided along the feed path of the web material N2 upstream of the guide roller 43, which allows the web material N2 to be spread before it is combined with the web material N. In some embodiments it can also be advantageous to install a spreader bar 63 along the feed path of the web material N, upstream of the guide roller 43. The second unwinder (not shown in FIG. 5) can be configured as illustrated in FIG. 1 and described above.

FIG. 5 schematically shows that the web material N can follow two different unwinding paths depending on whether the primary reel BP rotates clockwise (path of N with a dashed line) or counter-clockwise (path of N with a continuous line). The same alternative can be provided in both of the unwinders 31.1, 31.2.

FIG. 6 schematically shows various possible arrangements of the load cell associated with each of the guide rollers 43.1, 43.2. In FIG. 6 the guide roller is indicated with 43 and can represent both the guide roller 43.1 and the guide roller 43.2. In FIG. 6A the load cell is mounted coaxially to the guide roller 43. In FIGS. 6(B)-6(E) the load cell, illustrated schematically, is mounted laterally, for example between a seat of the bearing supporting the guide roller 41 and the load-bearing structure. In the various possible configurations, a component of the tension on the web material is detected.

The choice of the load cell is particularly important, as it must be able to detect the very small tensions to which the web material N, N2 is subject.

Figure 7:
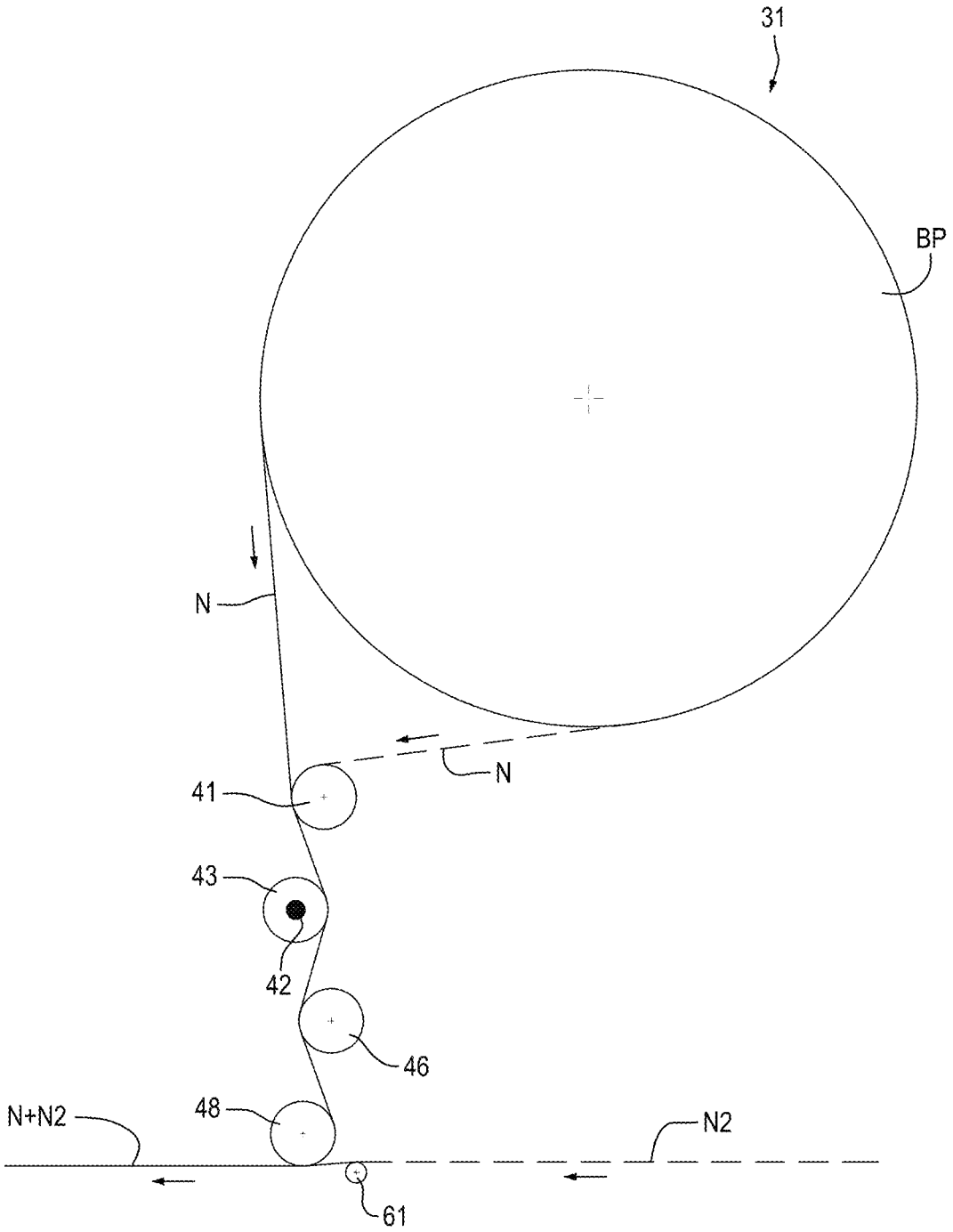
FIG. 7 shows a diagram of an unwinder in a further embodiment.

FIG. 7 schematically shows a further embodiment in which a different path of the web material N in the unwinding zone is provided. The same numbers indicate the same or equivalent parts to those described with reference to FIGS. 1 and 5, which shall not be described again. FIG. 7 schematically shows only the unwinder 31.1 limited to some of the components thereof. The guide rollers are indicated with 41, 43 and the load cell with 42. The configuration of FIG. 7 can be adopted for both of the unwinders 31.1 and 31.2.

In FIG. 7 the web material N is guided around a first guide roller 41 and around a second guide roller 43. Also in this case, the path upstream of the guide roller 41 can change as a function of the rotation (clockwise or counter-clockwise) of the primary reel BP. Downstream of the second guide roller 43, with which the load cell 42 is associated, a curved roller or bowed roller 46 can be provided, and downstream of this a further guide roller 48 can be provided, around which the web material N2 coming from the unwinder upstream (unwinder 31.2) is also guided.

The curved roller 46 can serve to spread the web material N transversely, and the roller 48 can be provided to optimize the angle of the web material N around the curved roller 46.

To ensure that it is not the web material N that imparts the rotation force of the rollers 46, 48, as already described with reference to the rollers 41, 43, both rollers 46, 48 (or optionally only one of them) can be motorized. Preferably, the curved roller 46 is always motorized to be able to perform its function in an optimum manner.

In all the illustrated embodiments, detection of the traction of the web material N, N2, i.e., of the tension thereof, by means of the load cell 42 (42.1, 42.2) allows the slip of the motors to be managed in each step of the machine cycle. Detection of the traction thus allows the control loop to be closed so that if the load cell 42.1, 42.2 detects a traction higher than the traction set, for example, by the operator on the control panel or memorized in advance in the control unit in a database associated therewith, the system will reduce the slip of the motors, decreasing the difference in speed between motors 8.1, 8.2 and motors 38.1, 38.2 and hence decreasing the difference between peripheral speed of the winding rollers 5, 7 and unwinding member 35.1, 35.2 of the two unwinders 31.1, 31.2. Vice versa, if the pull is below the set value, the control system will increase the slip of the motors. In this case, the preset traction will correspond to each speed or acceleration or deceleration ramp, so as not to pull the web material excessively, thereby preventing losses of thickness. With this system it is possible to achieve a very low loss of thickness, which can be around 2%, for instance.

While the invention has been described in terms of various specific embodiments, it will be apparent to those skilled in the art that various modifications, changes and omissions are possible without departing from the spirit and scope of the claims.

The invention claimed is:

1. A rewinding machine for unwinding primary reels of a web material and rewinding said web material in secondary reels, comprising:

a winding station with winding members operated by at least one winding motor;

at least one unwinder with at least one unwinding member operated by at least one unwinding motor;

at least one guide roller along a feed path of the web material;

at least one load sensor associated with the guide roller, the load sensor being configured to detect a parameter proportional to the tension of the web material guided around the guide roller; and a control unit adapted to modulate a difference in speed between the winding members and the unwinding member as a function of a signal from the load sensor.

2. The rewinding machine of claim 1, wherein the control unit is configured: to vary the speed of the unwinding member, and therefore of the primary reel in the unwinder, as a function of the signal of the load sensor, so as to maintain the tension in the web material around a desired value.

3. The rewinding of claim 1, wherein the control unit is configured to perform a winding cycle of secondary reels of web material coming from a primary reel comprising: an acceleration ramp from an initial speed to an operating speed, a winding step at operating speed, and a deceleration ramp from the operating speed to a final speed; and wherein the control unit is adapted to modulate the difference in speed between the winding members and the unwinding member as a function of the signal coming from the load sensor during at least one of said acceleration ramp and said deceleration ramp.

4. The rewinding of claim 3, wherein the initial speed and the final speed are equal to zero.

5. The rewinding of claim 1, wherein the control unit is configured to vary the speed of the unwinding member, and therefore of the primary reel in the unwinder, as a function of the signal of the load sensor, so as to maintain the tension in the web material around a desired value that is a function of at least one of: a characteristic of the web material; a winding speed of the web material.

6. The rewinding of claim 5, wherein the desired value is a function of the winding speed and the desired value for first speeds is greater than the desired value for second speeds, the first speeds being greater than the second speeds.

7. The rewinding of claim 1, further comprising a cutting device adapted to divide the web material into a plurality of strips, and wherein the winding station is adapted to wind the single strips in respective secondary reels placed side by side to one another.

8. The rewinding of claim 1, wherein the guide roller, with which said at least one load sensor is associated, is motorized.

9. The rewinder of claim 1, wherein the web material is a tissue paper web.

10. A method for rewinding a web material, comprising the steps of:

unwinding a primary reel of web material comprising at least one ply of tissue paper by at least one unwinding member controlled by an unwinding motor;

winding the web material in a winding station by at least one winding motor and forming at least one secondary reel in the winding station;

detecting a parameter function of the tension of the web material along the path between the unwinding member and a winding station;

controlling the difference between the speed of the winding motor and of the unwinding motor as a function of said parameter;

inserting at least one winding core into the winding station;

performing an acceleration ramp of the web material coming from the primary reel in the unwinder from an initial speed to an operating speed while winding the web material in the at least one secondary reel in the winding station;

performing winding of the web material around said at least one winding core at the operating speed;

performing a deceleration ramp from the operating speed to a final speed;

interrupting the web material; and removing said at least one secondary reel from the winding station.

11. The method of claim 10, wherein said parameter is a signal of a load sensor associated with at least one guide roller around which the web material is guided.

12. The method of claim 10, comprising the step of modulating the speed of at least one of said unwinding motor and winding motor to maintain the tension of the web material around a given value.

13. The method of claim 10, comprising the steps of: winding the web material at a winding speed; modulating the unwinding speed as a function of said parameter to maintain the tension of the web material around a given value.

14. The method of claim 13, wherein the given value is a function of at least one of: a parameter of the web material and the winding speed.

15. The method of claim 14, wherein the given value first winding speeds is greater than the given value for second winding speeds, the first winding speeds being greater than the second winding speeds.

16. The method of claim 10, wherein the initial speed and the final speed are equal to zero.

17. The method of claim 10, comprising the step of modulating the speed of the unwinder as a function of the parameter detected during at least one of said acceleration ramp and said deceleration ramp.

18. The method of claim 10, comprising the step of dividing the web material into a plurality of strips, and winding the single strips in respective secondary reels placed side by side to one another in the winding station.

19. A start-stop tissue paper rewinding machine for unwinding primary reels of a tissue paper web material and rewinding said web material in secondary reels through successive winding cycles spaced by stops for replacement of the secondary reels with new winding cores, the start-stop tissue paper rewinding machine comprising:

a winding station with winding members operated by at least one winding motor;

at least two unwinders, each unwinder of the at least two unwinders comprising at least a respective unwinding member operated by at least one respective unwinding motor;

for each of the at least two unwinders, at least one respective guide roller along a feed path of the web material unwound from the respective unwinder;

at least one respective load sensor associated with each guide roller, the sensor being adapted to detect a parameter proportional to the tension of the respective web material guided around the guide roller; and a control unit, adapted to modulate a difference in speed between the winding members and the unwinding member of each unwinder as a function of a signal from the respective load sensor.

20. A method for rewinding tissue paper web materials, from primary reels to secondary reels, through successive winding cycles spaced by stops for replacement of the secondary reels with new winding cores, the method comprising the steps of:

unwinding a first primary reel of tissue paper web material comprising at least one ply of tissue paper by a first unwinding member controlled by a first unwinding motor;

unwinding a second primary reel of tissue paper web material comprising at least one ply of tissue paper by a second unwinding member controlled by a second unwinding motor;

winding the first web material and the second web material in a winding station by at least one winding motor and forming at least one secondary reel in the winding station, wherein a plurality of secondary reels are produced in a sequence of start-stop cycles by winding the first web material from the first primary reel and the second web material from the second primary reel;

detecting a parameter function of the tension of the first web material and of the second web material along the respective path between the first unwinding member and the second unwinding member and the winding station;

controlling a difference between a speed of the winding motor and of each unwinding motor as a function of said parameter function.

* * * * *